US009392357B2

(12) United States Patent
Oxford

(10) Patent No.: US 9,392,357 B2
(45) Date of Patent: Jul. 12, 2016

(54) METHOD AND APPARATUS FOR ENHANCED STIMULATION OF THE LIMBIC AUDITORY RESPONSE

(76) Inventor: J. Craig Oxford, Nashville, TN (US)

( * ) Notice: Subject to any disclaimer, the term of this patent is extended or adjusted under 35 U.S.C. 154(b) by 0 days.

(21) Appl. No.: 13/108,057

(22) Filed: May 16, 2011

(65) Prior Publication Data

US 2011/0245585 A1 Oct. 6, 2011

Related U.S. Application Data

(63) Continuation of application No. 12/750,546, filed on Mar. 30, 2010.

(60) Provisional application No. 61/164,482, filed on Mar. 30, 2009, provisional application No. 61/179,078, filed on May 18, 2009.

(51) Int. Cl.

| | |
|---|---|
| ***H04R 1/22*** | (2006.01) |
| ***H04R 1/26*** | (2006.01) |
| *H04R 1/20* | (2006.01) |
| *H04R 1/40* | (2006.01) |

(52) U.S. Cl.

CPC *H04R 1/26* (2013.01); *H04R 1/403* (2013.01); *H04R 2201/403* (2013.01); *H04R 2440/07* (2013.01)

(58) Field of Classification Search

USPC ..... 381/386, 89, 303, 398, 309, 23.1, 152, 381/320, 321; 181/166, 171, 173

See application file for complete search history.

(56) References Cited

U.S. PATENT DOCUMENTS

| | | | | | |
|---|---|---|---|---|---|
| 1,668,509 | A | * | 5/1928 | Koch | 340/391.1 |
| 1,821,469 | A | * | 9/1931 | Hicks | 181/169 |
| 1,866,090 | A | * | 7/1932 | De Forest | 181/173 |
| 3,165,587 | A | * | 1/1965 | Alderson | 381/335 |
| 3,308,237 | A | * | 3/1967 | Novak | 381/98 |
| 3,514,701 | A | * | 5/1970 | Palatinus | 455/47 |
| 3,590,942 | A | * | 7/1971 | Globa | 181/146 |
| 3,830,986 | A | * | 8/1974 | Yamamuro | 381/414 |
| 4,006,308 | A | * | 2/1977 | Ponsgen | 381/387 |
| 4,031,318 | A | * | 6/1977 | Pitre | 381/386 |
| 4,160,133 | A | * | 7/1979 | Wiik | 381/401 |
| 4,181,819 | A | * | 1/1980 | Cammack | 381/300 |
| 4,243,840 | A | * | 1/1981 | Kates | 381/99 |
| 4,410,063 | A | * | 10/1983 | Yasue et al. | 181/147 |
| 4,421,949 | A | * | 12/1983 | Eberbach | 381/58 |
| 4,503,553 | A | * | 3/1985 | Davis | 381/303 |
| 4,584,439 | A | * | 4/1986 | Paddock | 381/89 |
| 4,805,221 | A | * | 2/1989 | Quaas | 381/335 |

(Continued)

FOREIGN PATENT DOCUMENTS

| | | | | | |
|---|---|---|---|---|---|
| JP | 60212099 | A | * | 10/1985 | H04R 9/02 |
| JP | 04135000 | A | * | 5/1992 | H04R 11/02 |
| JP | 06014393 | A | * | 1/1994 | H04R 9/02 |

*Primary Examiner* — Edgardo San Martin

(74) *Attorney, Agent, or Firm* — W. Edward Ramage; Baker Donelson

(57) ABSTRACT

A loudspeaker system for the optimization of sound production so as to achieve limbic and cortical arousal, comprising a resistance-controlled (or partially mass-controlled) woofer system, a mass-controlled (or partially resistance-controlled) midrange system, and a resistance-controlled tweeter system. This system may further comprise crossover networks of a particular configuration. By use of unsymmetrical networks of low order, it is possible to obtain a complete system which exhibits flat delay response.

10 Claims, 9 Drawing Sheets

MULTI-WAY LOUDSPEAKER SYSTEM

(56) References Cited

U.S. PATENT DOCUMENTS

| | | | | | |
|---|---|---|---|---|---|
| 4,882,760 | A * | 11/1989 | Yee | 381/335 |
| 4,884,655 | A * | 12/1989 | Freadman et al. | 181/145 |
| 4,940,108 | A * | 7/1990 | Selby | 181/145 |
| 5,105,906 | A * | 4/1992 | Wegner | 181/156 |
| 5,230,021 | A * | 7/1993 | Paddock | 381/405 |
| 5,249,237 | A * | 9/1993 | Paddock | 381/405 |
| 5,276,291 | A * | 1/1994 | Norris | 181/224 |
| 5,374,124 | A * | 12/1994 | Edwards | 381/351 |
| 5,502,772 | A * | 3/1996 | Felder | 381/386 |
| 5,608,810 | A * | 3/1997 | Hall | 381/398 |
| 5,815,589 | A * | 9/1998 | Wainwright et al. | 381/346 |
| 5,850,460 | A * | 12/1998 | Tanaka et al. | 381/186 |
| 5,870,484 | A * | 2/1999 | Greenberger | 381/300 |
| 5,887,068 | A * | 3/1999 | Givogue et al. | 381/89 |
| 6,061,461 | A * | 5/2000 | Paddock | 381/424 |
| 6,069,962 | A * | 5/2000 | Miller | 381/300 |
| 6,104,822 | A * | 8/2000 | Melanson et al. | 381/320 |
| 6,115,475 | A * | 9/2000 | Alexander | 381/99 |
| 6,169,812 | B1 * | 1/2001 | Miller | 381/300 |
| 6,381,334 | B1 * | 4/2002 | Alexander | 381/99 |
| 6,450,289 | B1 * | 9/2002 | Field et al. | 181/224 |
| 6,607,432 | B2 * | 8/2003 | Schaake | 454/143 |
| 6,628,793 | B1 * | 9/2003 | Porzilli et al. | 381/182 |
| 6,643,379 | B1 * | 11/2003 | Onglao | 381/351 |
| 6,719,078 | B2 * | 4/2004 | Nakamura | 180/69.22 |
| 6,760,446 | B1 * | 7/2004 | Miller | 381/1 |
| 6,768,806 | B1 * | 7/2004 | Button et al. | 381/401 |
| 6,816,598 | B1 * | 11/2004 | Budge | 381/89 |
| 7,031,489 | B2 * | 4/2006 | Amino | 381/414 |
| 7,090,047 | B1 * | 8/2006 | Lee et al. | 181/199 |
| 7,130,430 | B2 * | 10/2006 | Milsap | 381/77 |
| 7,227,970 | B2 * | 6/2007 | Calderwood et al. | 381/412 |
| 7,237,648 | B2 * | 7/2007 | Lee et al. | 181/199 |
| 7,272,238 | B2 * | 9/2007 | Kemmerer et al. | 381/414 |
| 7,337,876 | B2 * | 3/2008 | Larsen | 181/225 |
| 7,460,673 | B2 * | 12/2008 | Miller | 381/1 |
| 7,672,472 | B2 * | 3/2010 | Oxford et al. | 381/423 |
| 7,796,775 | B2 * | 9/2010 | Oxford et al. | 381/386 |
| 7,916,878 | B2 * | 3/2011 | Bank et al. | 381/152 |
| 8,045,746 | B2 * | 10/2011 | Takayama et al. | 381/398 |
| 8,094,868 | B2 * | 1/2012 | Oxford et al. | 381/430 |
| 8,144,900 | B2 * | 3/2012 | Oxford et al. | 381/301 |
| 2002/0018578 | A1 * | 2/2002 | Burton | 381/431 |
| 2002/0146139 | A1 * | 10/2002 | Oplinger | 381/300 |
| 2004/0047479 | A1 * | 3/2004 | Porzilli et al. | 381/182 |
| 2005/0180577 | A1 * | 8/2005 | Horbach | 381/27 |
| 2006/0018503 | A1 * | 1/2006 | Endo | 381/412 |
| 2006/0023898 | A1 * | 2/2006 | Katz | 381/98 |
| 2007/0121994 | A1 * | 5/2007 | Hayasaka et al. | 381/420 |
| 2007/0147652 | A1 * | 6/2007 | Takayama et al. | 381/396 |
| 2010/0246880 | A1 * | 9/2010 | Oxford et al. | 381/386 |
| 2011/0096947 | A1 * | 4/2011 | Oxford et al. | 381/182 |
| 2011/0211722 | A1 * | 9/2011 | Bank et al. | 381/369 |
| 2012/0114147 | A1 * | 5/2012 | Ohashi et al. | 381/182 |
| 2015/0078610 | A1 * | 3/2015 | Voishvillo et al. | 381/396 |

* cited by examiner

MULTI-WAY LOUDSPEAKER SYSTEM

METHOD AND APPARATUS FOR ENHANCED STIMULATION OF THE LIMBIC AUDITORY RESPONSE

This application is a continuation of U.S. Utility application Ser. No. 12/750,546, filed on Mar. 30, 2010, which claims benefit of and priority to U.S. Provisional Application Nos. 61/164,482, filed Mar. 30, 2009, and 61/179,078, filed May 18, 2009, and is entitled to those filing dates in whole or in part for priority. The specification, figures and complete disclosure of U.S. Utility application Ser. No. 12/750,546 and U.S. Provisional Application Nos. 61/164,482 and 61/179,078 are incorporated herein by specific reference for all purposes.

FIELD OF INVENTION

This invention relates to a method and apparatus for enhanced stimulation of the limbic response to audio signals. More specifically, the invention results in an identifiable physiological effect through technical means of sound production.

BACKGROUND

Music in its many forms is recognized as one of the great sources of pleasure for mankind. The phrase "music to my ears" is understood to generalize to any welcome sensory input. The lullabies of mothers are the first experience of the power of music to soothe for newborns, and empowerment for mothers and fathers. The power of music to soothe humans even when brains are at the very earliest stages of development is never lost.

Music has been recognized as a source of emotional comfort at times of major loss. Thus, requiems such as those of Mozart or Verdi, as well as the chants of Gregorian monks and singers from many religions, are recognized for their power to diminish the sense of loss and vulnerability in those who have experienced the death of beloved relatives or friends, and to relieve anxiety by creating a sense of community and link to powerful historical forces.

The therapeutic benefits of music have been acknowledged for centuries by many cultures and religions. The power of music to facilitate healing sick is recognized by the discipline of music therapy, which is now well-established as of provable benefit to many who are ill, including those with coronary artery heart disease and serious mental disorders, such as major depression and schizophrenia.

Music from a variety of genres, including jazz, blues, rock, opera, classical, country, bluegrass, folk, and heavy metal, is a highly valued way to experience pleasure. Extensive scientific research in the last 50 years has established that pleasure results from stimulating activity in specific areas of the medio-temporal lobes of the brain known as the limbic system. The limbic system is a key part of the human neural apparatus, as it enables us to respond emotionally and cognitively to various stimuli, threatening as well as pleasure-giving, in the environment.

The limbic system is a set of brain structures, including the hippocampus, amygdala, anterior thalamic nuclei, and limbic cortex, which support a variety of functions, including emotion, behavior, long term memory, and olfaction. For most, the pleasure experienced from listening to music, whether live or recorded, and the capacity of music to make the listener feel, think and remember its special qualities, results from the individual's limbic system response. However, music also can sometimes be aversive because of subjective responses to its nature as combinations of sounds based on tonalities, timing, and rhythms, painful associations of an idiosyncratic nature with the music, of aspects of its production, e.g. volume, repetition, and, finally, the quality of the recorded sound and its reproduction by man-made equipment.

Accordingly, what is needed is a method, and accompanying apparatus, to enhance the stimulation of the limbic system response in listeners of recorded audio signals, and produce an identifiable physiological effect through technical means of sound production.

SUMMARY OF INVENTION

Various exemplary embodiments of the present invention, as described below, are directed to the optimization of sound production so as to achieve limbic and cortical arousal, leading to the experiences of authenticity and pleasure. This includes, but is not limited to, sound production through loudspeakers.

In one embodiment, the present invention comprises the use of a resistance-controlled (or partially mass-controlled) woofer system, a mass-controlled (or partially resistance-controlled) midrange system, and a resistance-controlled tweeter system. This system may further comprise crossover networks of a particular configuration. By use of unsymmetrical networks of low order, it is possible to obtain a complete system which exhibits flat delay response.

In addition, in the middle and high-frequency ranges the correct combination (or combinations) of these elements will result in an electrical input impedance to the system which is relatively independent of frequency in both magnitude and phase. This improves the sound reproduction because many types of power amplifiers used to drive a loudspeaker system may be adversely affected by a widely varying load impedance (as presented by the loudspeaker). The specific performance degradation in the power amplifier will affect both the transient response and the frequency response. Flat magnitude and phase of the loudspeaker impedance will reduce or eliminate these problems.

Another exemplary embodiment of a loudspeaker system with these elements comprises one or more bending-wave transducers, one or more mid-range transducers, and two woofers in opposition. The bending-wave transducers and mid-range transducers may optionally be placed in a line-array.

DETAILED DESCRIPTION OF EXEMPLARY EMBODIMENTS

Figure 1:
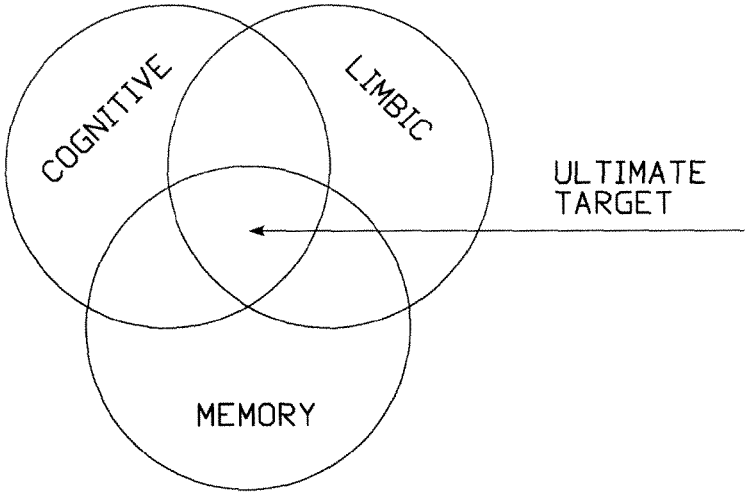
FIG. 1 shows a representation of the effect of music on regions of the brain.

The reproduction of music by means of technical apparatus and procedures should stimulate both the autonomic and cognitive centers of the brain. This is because, while the limbic (autonomic) response is immediate, it is quickly followed by a cognitive response as well. Failure to engage the limbic response results in reduction of emotional connection in the listener with the music. While limbic system arousal is essential to the ability of music to arouse emotions in listeners, the limbic system utilizes the frontal cortex of the brain to process the experience. Cortical regions of the brain enable the listener to understand and evaluate the complexity of music in concert with the hippocampus of the limbic system, where long term memory storage is mainly located. This combination allows the listener to compare current and past performance of the same and different performances of the same music, with different music, or with specific events associated with the music. Indeed, as shown in FIG. 1, the experience of music is dependent upon and, in turn, influences virtually all regions of the brain and through that means, the physiology of the entire organism.

The sounds of live music impacts the listener with immediacy and, in most circumstances, will decay rapidly, leaving a true music lover with a unique feeling of an authentic aesthetic experience. Non-live music, because it must be played through electronic devices, e.g., a CD player, amplifiers, loudspeakers, or ear phones, often deprives the listener of the feeling of authenticity. The listener often knows that listening to recorded music is a derivative experience, with much of the content of the live performance missing.

For recorded music to produce as close to optimal pleasure as possible, it must stimulate the limbic system and also activate higher cortical areas of the brain. The listener can then make judgments and integrate emotional and cognitive information to experience something close to an authentic listening experience. This results from immediate and, within the right range, intense stimulation of the limbic response. Thinking about music, without limbic arousal, cannot produce the pleasure which comes from hearing it and having it arouse limbic system chemical and electrical changes, which are believed to be mediated by the neurotransmitter, dopamine. Dopamine is the primary pleasure chemical which the limbic system is geared to produce in the right amounts at the right time. Music stimulates the release of dopamine, as well as other pleasure enhancers such as the endorphins.

There is a threshold for the experience of authenticity in listening to reproduced sound which must be met and exceeded in order to stimulate the limbic system response effectively. This is a function of the ability of the electronic sound reproduction system to reproduce the intensity, color, timbre, timing, and multidirectional nature of the sound the listener experiences in the live music setting. The quality of the loudspeaker which sends sound waves to the listener is a critical component of effort to achieve authenticity through limbic arousal.

A surrogate marker or indicator for the limbic response is the measurement of physiological responses in the body and brain, such as skin conductance, heart rate, and changes in the EEG. Limbic response can also be measured by changes in brain activity using modern magnetic resonance imaging methods; however, this is very costly. Studies have been performed comparing limbic system arousal with music produced by the linear Pace Conditioning Mode (PCM), which is digitized music. Music which is generated through an MP3-encoded version of the same music always fails to evoke as great a physiological response, as demonstrated by heart rate, galvanic skin response, and other measures.

Various exemplary embodiments of the present invention, as described below, are directed to the optimization of sound production so as to achieve limbic and cortical arousal, leading to the experiences of authenticity and pleasure. This includes, but is not limited to, sound production through loudspeakers.

A limbic response to sounds or audio signals can be stimulated in a variety of ways. First, one of the more obvious stimulants is "suddenness." This evokes what is described in psychological research as the "startle" response or reflex. "Suddenness" in a sound can be found, for example, in a gunshot, the snap of a twig, or the clap of hands. These may be described technically as "transient" sounds, as distinct from continuous or "steady-state" sounds. For music, examples may include the clang of a symbol or the sound of a violin string being bowed and then abruptly stopping its vibration.

A second stimulant is "loudness" (i.e., high volume sounds), which may combine with suddenness. A gunshot, for example, combines loudness and suddenness. Intensity at close range, such as standing near a passing train or in front of the speakers at a loud rock concert, can evoke a sense of being overwhelmed or of great danger, and result in an unpleasant, frightening, or even painful experience.

In contrast, a third stimulant may be "softness" (i.e., low intensity sounds). "Softness" may cause heightened attention, such as in listening for the approach of a predator, or straining to hear a sound played gently. Softness can evoke a soothing or calming response, but also unpleasant over stimulation. The range of loudness to softness is described technically as "dynamic range".

Spectrum, or the distribution of sounds with respect to frequency, is another key dimension. The middle frequencies, which are occupied by the human voice, are strongly related to both limbic and cognitive response in humans (e.g., hearing and responding to maternal and paternal voices). The extreme frequencies, both high and low, are more strongly related to the limbic response. For example, the driving beat of music, the footfalls of marching soldiers, the rumble of a vehicle all involve frequencies below the range of the human voice. In contrast, transient sounds, such as those mentioned above, are rich in higher frequencies above the range of the human voice.

The technological art of recording and reproducing sound is based upon both what is objectively measurable and what is subjectively describable. Objective measurements are useful as a tool for improving sound recording and reproducing devices in order to establish basic technical characteristics. However, the measurements do not completely capture the resulting sound quality or capacity to produce pleasure. Subjective description, by definition, requires cognitive processing. The widespread use of jury-based comparative ratings in the audio field is based upon cognitive processing. This is subjective and will sometimes produce disagreement among experts, causing some to question the value or even the validity of comparative listening tests, blind or otherwise. Objective measurements of reproduced sound and cognitive judgment have the potential to facilitate sound that is emotionally-involving.

In one exemplary embodiment, the present invention comprises a method, and related apparatus, for the optimization of transient reproduction, dynamic range, and spectral extent. These components are closely linked, although their optimization is not always congruent.

With regard to transient reproduction, it has been thought that the criterion for good transient response is wide frequency response. This comes from the Fourier transform which establishes the relationship between time and frequency for linear time-invariant systems. However, loudspeaker systems operating in real rooms are not linear, time-invariant systems. Instead, embodiments of the present invention use the simple equation F=ma, force equals mass times acceleration. Transient sounds are characterized by the rapid acceleration of the air by some physical object. In the case of loudspeakers, it is the diaphragm of the loudspeaker which must be accelerated to move the air, thus producing the sound. Since a=F/m, it follows that to have high acceleration in order to accurately reproduce transient sounds, the mass of the diaphragm must be very low, and the force available to move it must be very high. In fact, music and other sounds are discontinuous, resulting in "jerk," which is the derivative of acceleration (i.e., the rate of change of acceleration), just as acceleration is the derivative of velocity.

Figure 2:
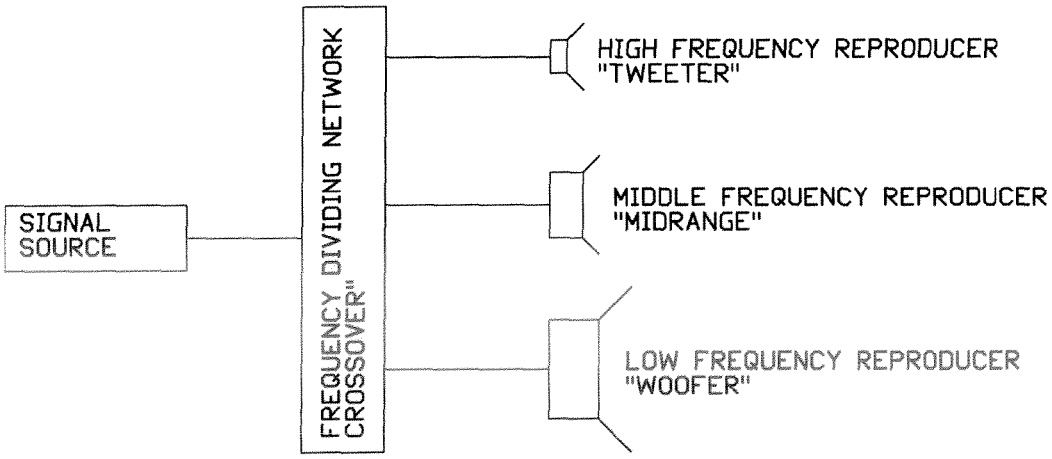
FIG. 2 is a diagram of a multi-way loudspeaker system.

The mass of the speaker diaphragm may be reduced by simply making it smaller. Unfortunately, this increases the radiation resistance to the point where it is not possible to impart enough acoustic power to the air to obtain the required loudness. Radiation resistance is proportional to wavelength (and inversely proportional to frequency), so the loudspeaker system is divided into parts. A large diaphragm is used for the low frequencies, in order to radiate enough power. A smaller diaphragm can be used for the middle frequencies. For the high frequencies, it is usually not sufficient to simply further reduce the diaphragm size, and some other approach must be used. This is because the range of human hearing covers a ratio of about 1000:1 in wavelength, and it is clearly not practical that the reproducers (i.e., diaphragms) would span that range of physical size. As a result, multi-way loudspeaker systems, such as shown in FIG. 2, are used.

With regard to dynamic range, the dynamic range of a loudspeaker is the range from the softest sound it will reproduce to the loudest sound it will reproduce. The response generally is linear over the whole dynamic range. That is, a given increase in the electrical input produces the same increase in the acoustic output. When this is not the case there is said to be compression.

There are two primary compression mechanisms, both of which should be avoided in loudspeaker construction. The first is instantaneous compression, which is due to the motor of the speaker having a non-linear reduction in force near the limits of its excursion. The second is long-term compression, which is usually thermal in origin. Here, the voice-coil of the motor heats up and its resistance rises. Since force is proportional to current, the increasing resistance diminishes the available force.

The upper end of the dynamic range (i.e., the highest acoustic power) is limited not only by the motor, but also by the ability of the diaphragm to withstand the accelerative forces. This is why the diaphragm cannot be too light. In the woofer (low frequency) and midrange drivers, this can be addressed by proper selection of diaphragm material and geometry. However, heavy woofer diaphragms and soft midrange diaphragms do not lead to good transient reproduction, as described above.

For a tweeter (high frequency), one solution is to use numerous tweeters arranged in a line. For a given sound pressure, the required acceleration from each tweeter is reduced according to the number of tweeters. Another approach abandons the attempt at unitary motion of the diaphragm in favor of the propagation of a bending wave.

With regard to spectral extent, this is often referred to as frequency response in connection with loudspeaker technology. In the context of the present invention, however, it has much greater implications. Frequency response is customarily defined as the sound pressure amplitude on some specified axis, usually perpendicular to the front panel, at a specified distance, as a function of frequency. The measurement is usually performed at a specified input voltage so that the voltage sensitivity may also be obtained. This is generally what is called a small-signal characteristic.

It is also necessary to insure that the frequency response is maintained dynamically. That is, it must not change as a function of loudness. This is a requirement for good dynamic range.

Figure 3:
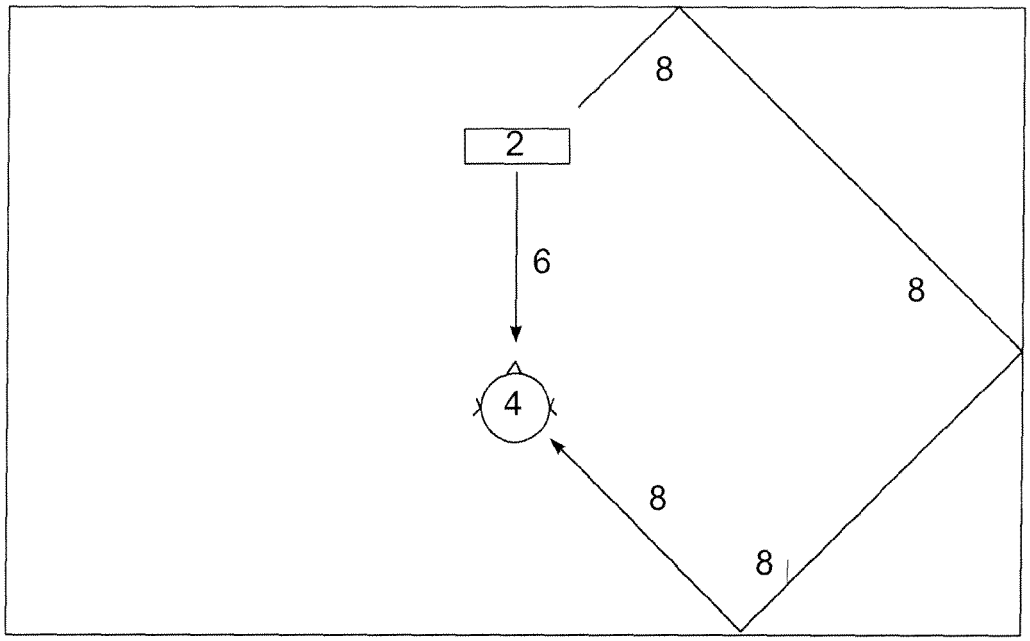
FIG. 3 is a diagram of a placement of a loudspeaker in a space.

The frequency response also should be maintained spatially. As shown in FIG. 3, it should be fairly uniform both on the axis of measurement 6 of the loudspeaker 2, which usually is about the same as the direct path 6 to the listener 4, as well as at other locations off the axis. This is required because loudspeakers are normally used in rooms where reflections 8 are present. It is important for the reflections to be "illuminated" by sounds which are as similar as possible to the direct sound, i.e., the first sound to reach the listener. This allows the ear-brain system to factor out the room so it does not interfere with the sounds being reproduced.

Figure 4:
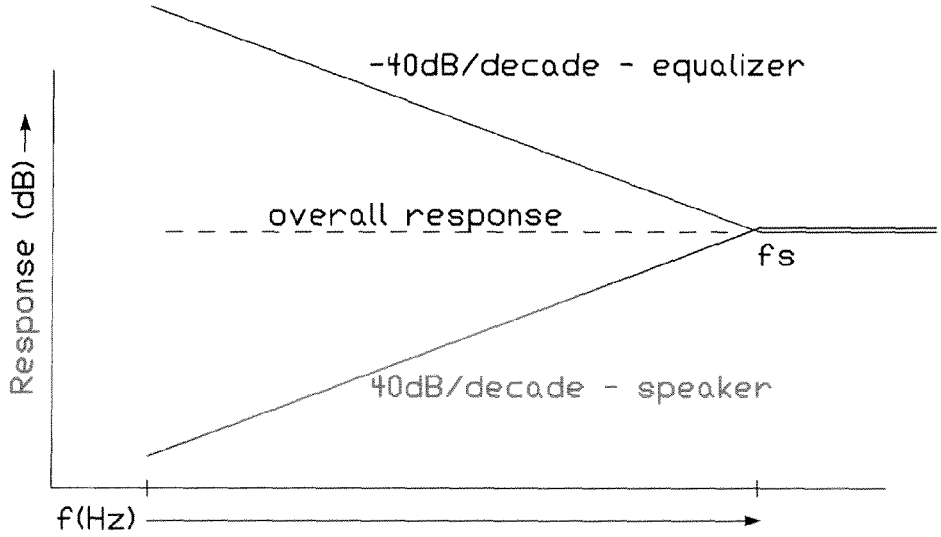
FIG. 4 shows transient response for a stiffness-controlled woofer.

A loudspeaker apparatus in accordance with an exemplary embodiment of the present invention comprises the simultaneous application of numerous techniques as described below. For low-frequency sounds, a woofer system is implemented in one or more configurations based on physical size and acoustic output. In general, the woofer systems of various embodiments are arranged so that the fundamental resonance frequency (fs) is at the upper end of the operating frequency range. Because of this, the system is stiffness-controlled rather than mass-controlled. When the system is stiffness-controlled, the response is not flat but rather decreases monotonically with frequency at a rate of 40 dB/decade. When this response is equalized by a biquadratic network with equal and opposite response, by superposition the reactances cancel. The woofer is therefore operating resistively over the range of interest. This results in flatter group delay which corresponds to superior transient response, as shown in FIG. 4.

Figure 5:
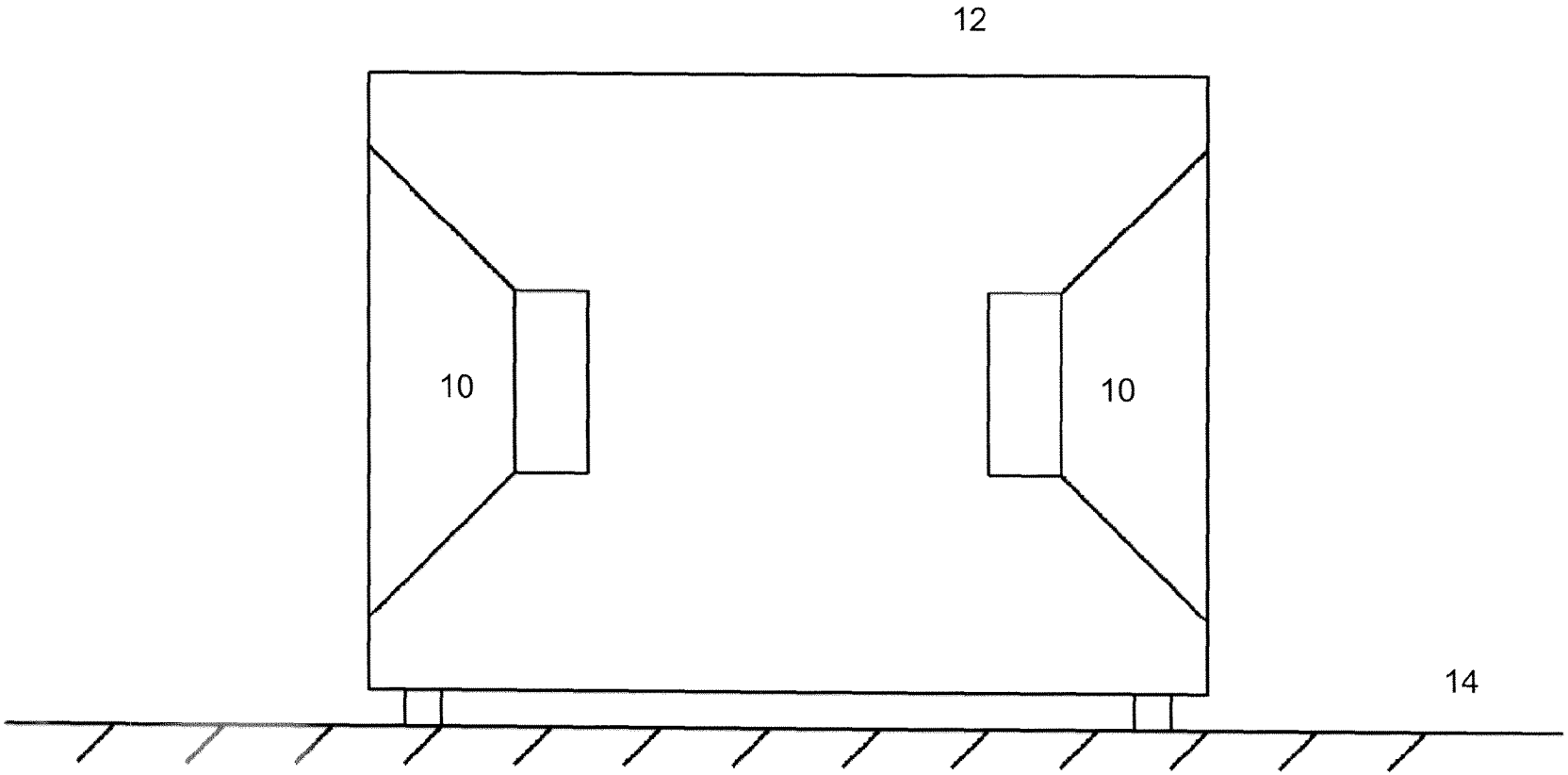
FIG. 5 shows a woofer system with mechanically-opposed pairs of woofers.

Further, in one exemplary embodiment, as seen in FIG. 5, the woofers 10 are used in mechanically opposed pairs with symmetry of the containment structure or enclosure 12. This has two benefits: first, the reaction force of each woofer is cancelled by the other; second, this prevents any tendency to structural twisting motions in the enclosure. A system arranged in this way causes a further improvement in transient response because the supporting structure 14 (e.g., the room) is not mechanically excited and therefore does not store energy, which would muddy the sound.

For mid-frequency sounds, the "limbic" optimization of the midrange reproducer is performed, in order, for the following: (1) transient response; (2) dynamic range; and (3) frequency response.

The mass of the moving parts is reduced as much as possible through the use of lightweight but stiff diaphragm material, and a low-mass voice-coil former and winding. Electrical inductance in the voice-coil causes two problems. First, this inductance reflected to the mechanical system is indistinguishable from mass. Second, this inductance, and therefore its reactance, tends to be modified by the instantaneous voice-coil position. This results in signal-dependent amplitude-modulation of high frequencies when strong low frequencies are simultaneously being reproduced. This is called amplitude intermodulation distortion and it is very audible. When it is reduced or eliminated, the sound is perceived as being less congested and more clear.

Figure 6:
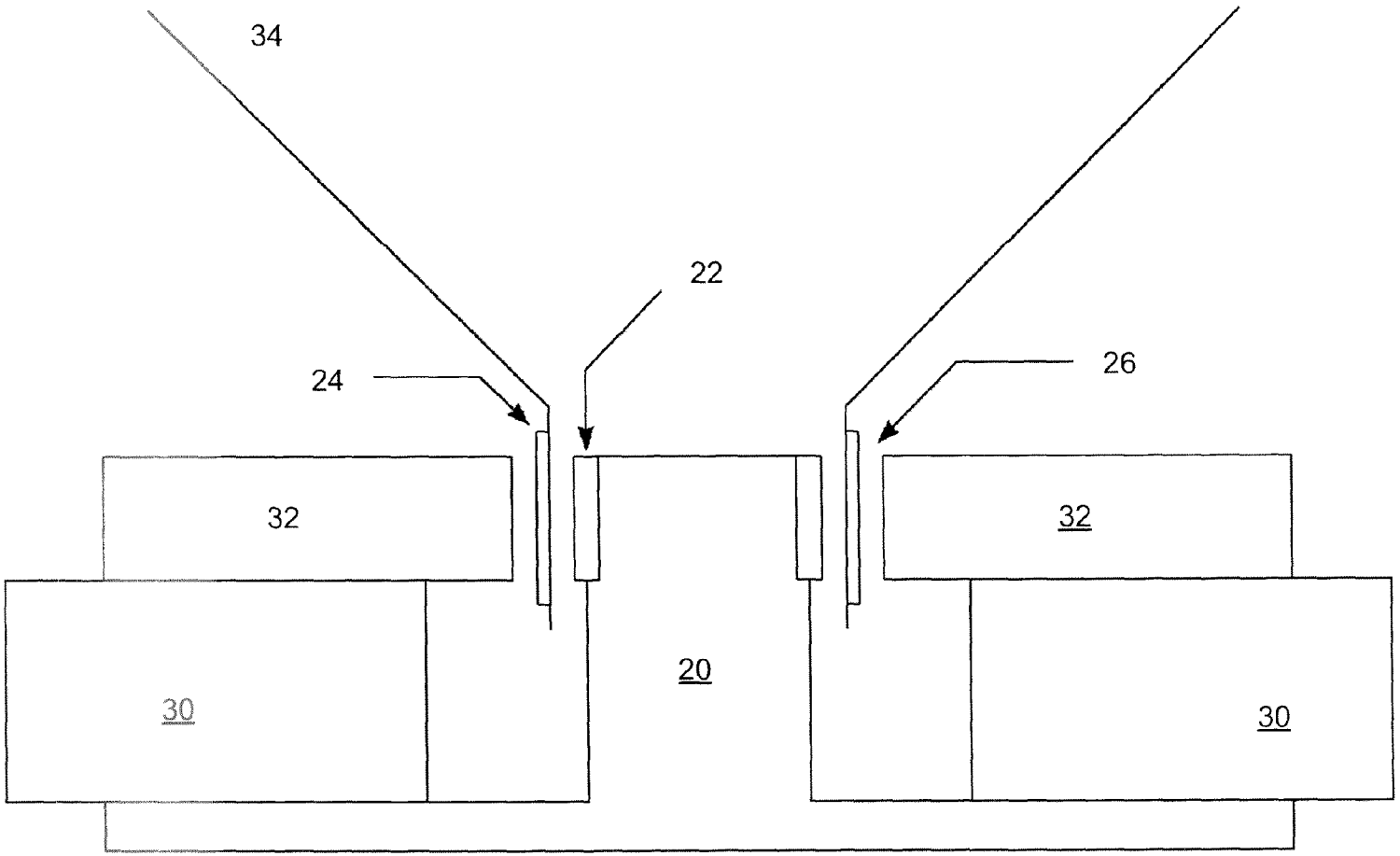
FIG. 6 shows a mid-range transducer with a shorting ring.

As shown in FIG. 6, one can reduce the inductance by the use of a conductive shorting ring 22 on the pole-piece 20 of the magnetic circuit of the motor in a transducer 18, the transducer 18 further comprising a magnet 30, top plate 32, and diaphragm or cone 34 with a voice-coil 24. In one embodiment, the correct location for this shorting ring 22 is at the same height as the voice-coil 24. The more proximate the shorting ring 22 is to the voice-coil 24, the greater the benefit. To locate the shorting ring in this way requires the magnetic gap 26 in which the voice-coil 24 travels to be widened enough to accommodate the shorting ring 22 without crowding the voice-coil 24. Because the magnetic flux across the gap 26 is proportional to the square of the gap length, there will be a substantial reduction in magnetic flux (typically notated as "B"). The force which can be produced by the motor (F=Bli, where "l" is the length of voice-coil conductor in the gap and "i" is the current through the voice-coil) is therefore reduced.

In another embodiment, the thickness of the shorting ring 22 should be made as thin or as small as possible. The shorting ring conducts significant current at high frequencies, and if its AC resistance is too high, it will not be effective.

The above solution with the widened gap requires more magnet material to overcome the increased reluctance in the gap, and thus increases expense.

The dynamic range optimization comprises of two parts. First, the linear excursion of the motor (i.e., the length of the stroke with uniform force) must be great enough to support the required diaphragm excursion to the lowest frequency of interest. This avoids instantaneous compression. Second, the sensitivity of the speaker must be high enough that the highest required acoustic output will not result in significant heating of the voice-coil. This, combined with adequate ventilation of the voice-coil, avoids thermal compression.

In one embodiment, the frequency optimization cannot be done in the loudspeaker unit itself. The first two optimizations result in a non-flat frequency response which must be corrected in the frequency-dividing (crossover) network, as previously shown in FIG. 2. If the loudspeaker optimizations for transient response and dynamic range have been performed correctly, the required compensation of the frequency response can be done with a low-order network. A low-order network will cause minimal added transient error. If the correction is exact, then by superposition there is no transient error.

Figure 8:
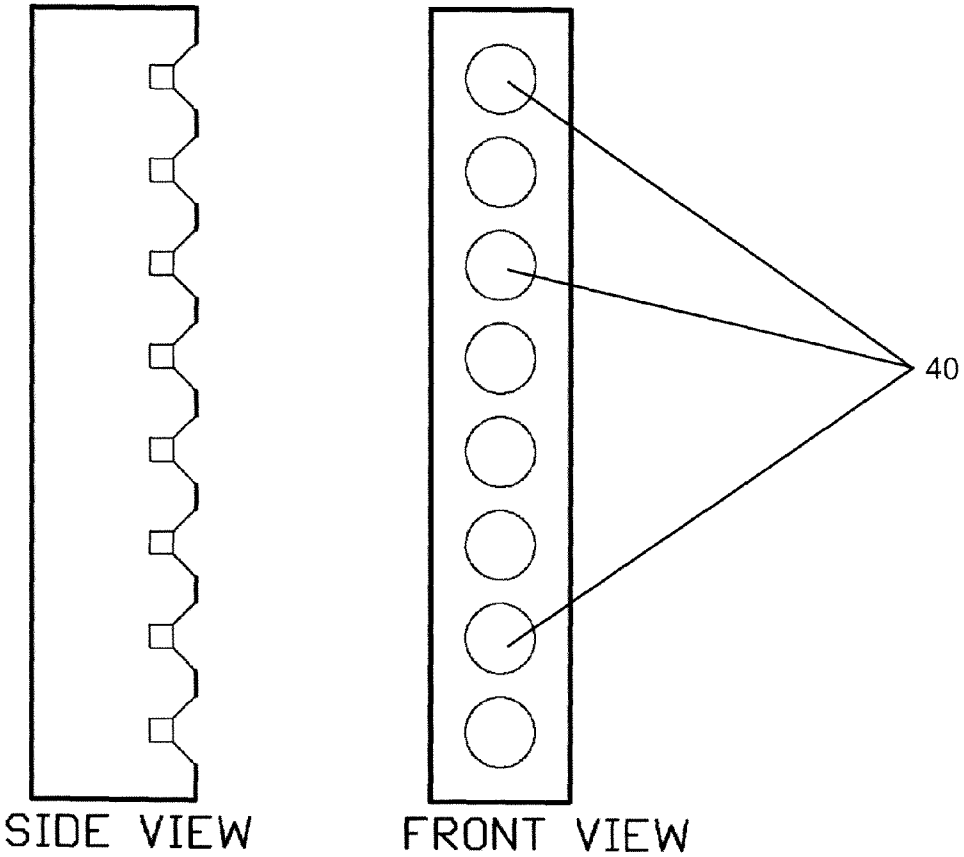
FIG. 8 shows an array of mid-range transducers.

Depending on the total dynamic-range requirements of the system, several midrange drivers 40 as described may be used in a line-array, as seen in FIG. 8. All the benefits of the applied techniques are realized along with much greater acoustic power than can be obtained with one driver alone. The typical improvement (in dB) is 10 log n, where n is the number of drivers in the line.

Figure 9:
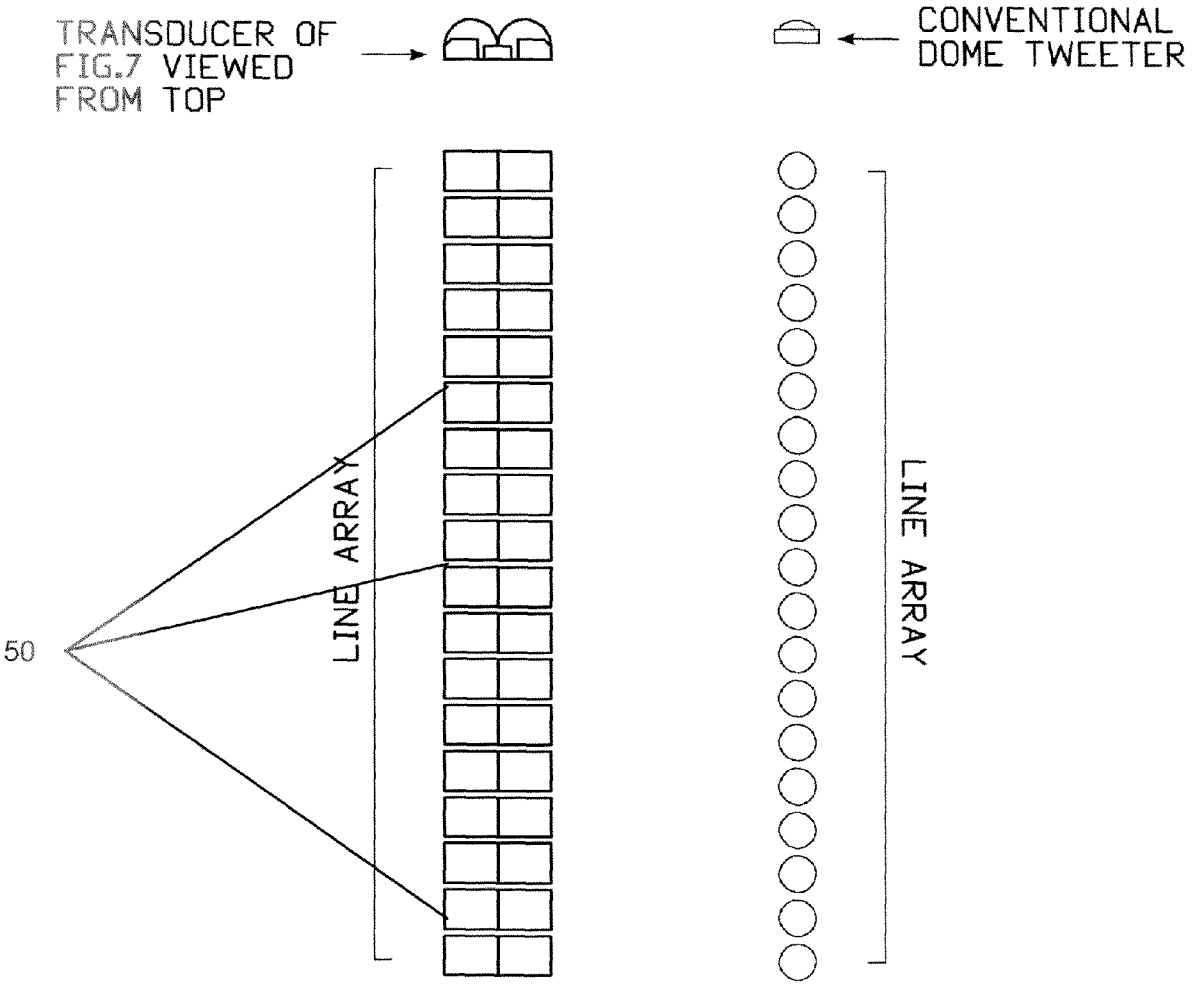
FIG. 9 shows an array of bending-wave transducers.

With regard to high frequency optimization, the primary difficulties are extension of frequency response, and production of sufficient acoustic power output. In a conventional tweeter, the diaphragm diameter is about one inch and the voice-coil is placed at the outer diameter. This is conventionally known as a "dome" tweeter. Such a design will not produce enough acoustic power due to deformation of the diaphragm during the very high accelerations. One solution is to use more than one such tweeter, usually many more, arranged in a line-array, as seen in FIG. 9. However, this is not compact and it is expensive.

Figure 7:
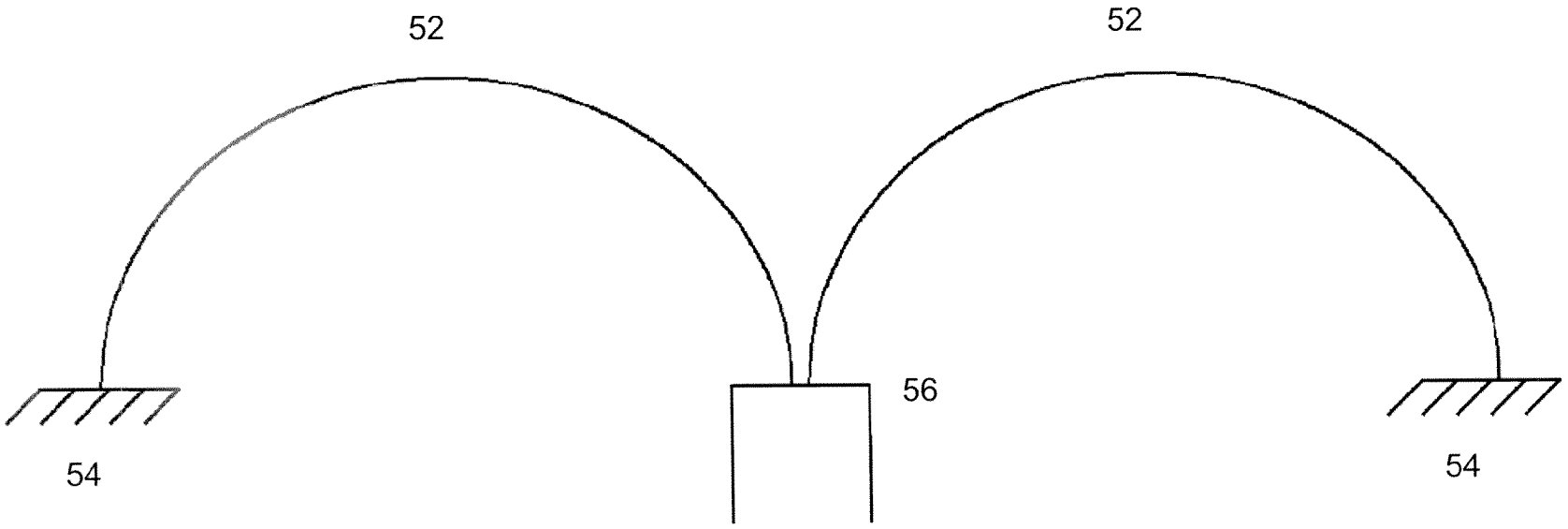
FIG. 7 shows a bending-wave transducer.

An alternative method of high-frequency reproduction is possible in the form of a bending-wave transducer 50, shown in FIG. 7. In such a transducer, the motor 56 starts a wave motion in the proximal end of a pair of plastic film diaphragms 52, which may be bent or curved as shown. This wave propagates by a bending motion to the distal end of the film diaphragm 52 where any remaining energy is absorbed in a damping structure 54. The overwhelming advantage to this transducer type is that the motor is not required to accelerate the mass of the diaphragm, only to set the wave in motion. It can be likened to the crack of a whip (i.e., "jerk").

Another advantage of this type of transducer is that the area of the film diaphragms 52 can be quite large. Because the bending wave produces motion perpendicular to the surface, the acoustic radiation efficiency is quite high. This has the advantage that very little electric power is required in the motor so very little heat is produced. As a result, there is essentially no thermal compression.

The bending-wave transducer 50 operates in the resistive domain rather than the mass-controlled domain of conventional direct-radiator tweeters. This causes the acoustic output to be in-phase with the electrical input, rather than lagging in quadrature. As with the tweeter above, further advantage can be realized by using several of the transducers, as shown in FIG. 7, in a line array, as shown in FIG. 9.

A bending-wave transducer also may be used for the midrange. Similarly, the electromagnetic mechanical advantage of the mass-reducing inductance-lowering features described for the midrange above may also be used with the woofer system. Digital signal processing also may be used on the woofer system to reduce size and weight.

Figure 10A:
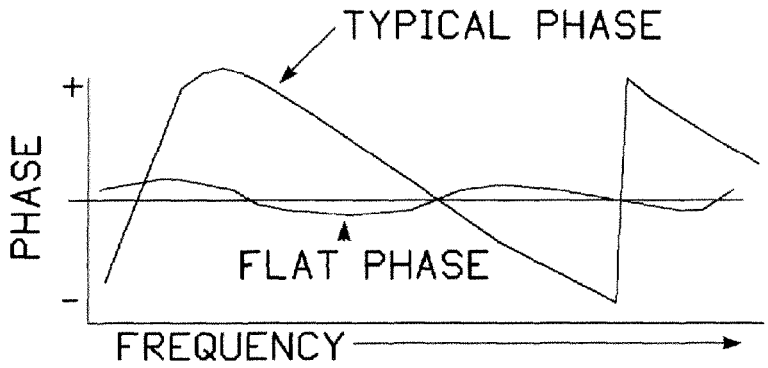
FIG. 10 shows three graphs of phase and amplitude for various loudspeaker systems.
Figure 10B:
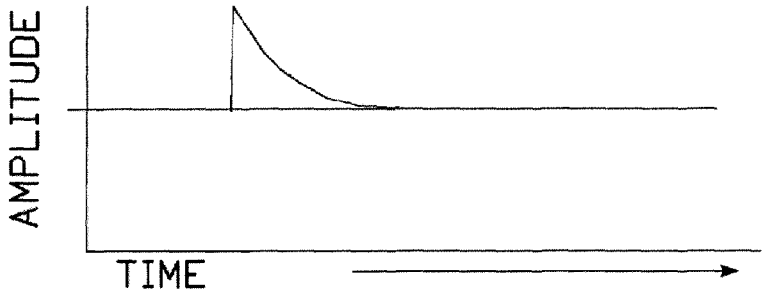
Figure 10C:
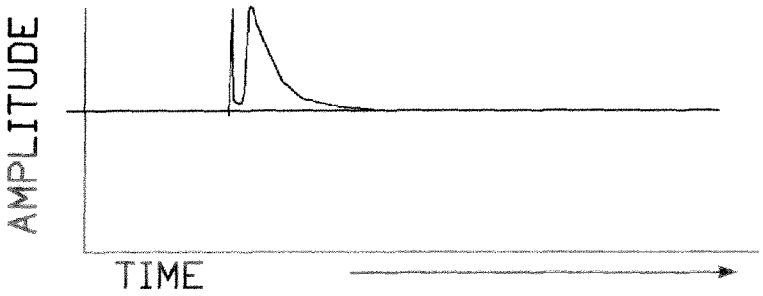

The use of a resistance-controlled (or partially mass-controlled) woofer system, a mass-controlled (or partially resistance-controlled) midrange system, and a resistance-controlled tweeter system requires crossover networks of a particular configuration. By use of unsymmetrical networks of low order, it is possible to obtain a complete system which exhibits flat delay response. In one embodiment, this is a fundamental requirement for good transient reproduction because flat delay means that the various elements of a transient sound are preserved in their original time relationships. This may be observed in several ways. First, flat delay corresponds to flat phase response after the causal delay has been removed from the system (see FIG. 10*a*). Second, a DC step voltage input may be applied to the loudspeaker system. A single sharp rising edge (as seen in FIG. 10*b*) indicates that all parts of the system are operating together. If the edge is decomposed into visible separate responses (as seen in FIG. 10*c*), then the delay is not uniform. The triangular falling shape after the leading edge results from the loudspeaker not being able to reproduce DC, so the output decays. The causal delay, which must be removed in order to produce the shape seen in FIG. 10*a*, comprises primarily the time it takes for the sound to travel from the loudspeaker to the measuring microphone, plus inherent delays in the transducers themselves (which must be compensated in the crossover network and by the physical placement of the drivers with respect to one another). FIG. 10*a* shows a typical phase response for a loudspeaker system as well as a flat phase response obtained by the methods and inventions described herein.

In addition, in the middle and high-frequency ranges the correct combination (or combinations) of these techniques will result in an electrical input impedance to the system which is relatively independent of frequency in both magnitude and phase. This improves the sound reproduction because many types of power amplifier used to drive a loudspeaker system may be adversely affected by a widely varying load impedance (as presented by the loudspeaker). The specific performance degradation in the power amplifier will affect both the transient response and the frequency response.

Flat magnitude and phase of the loudspeaker impedance will reduce or eliminate these problems.

Figure 11:
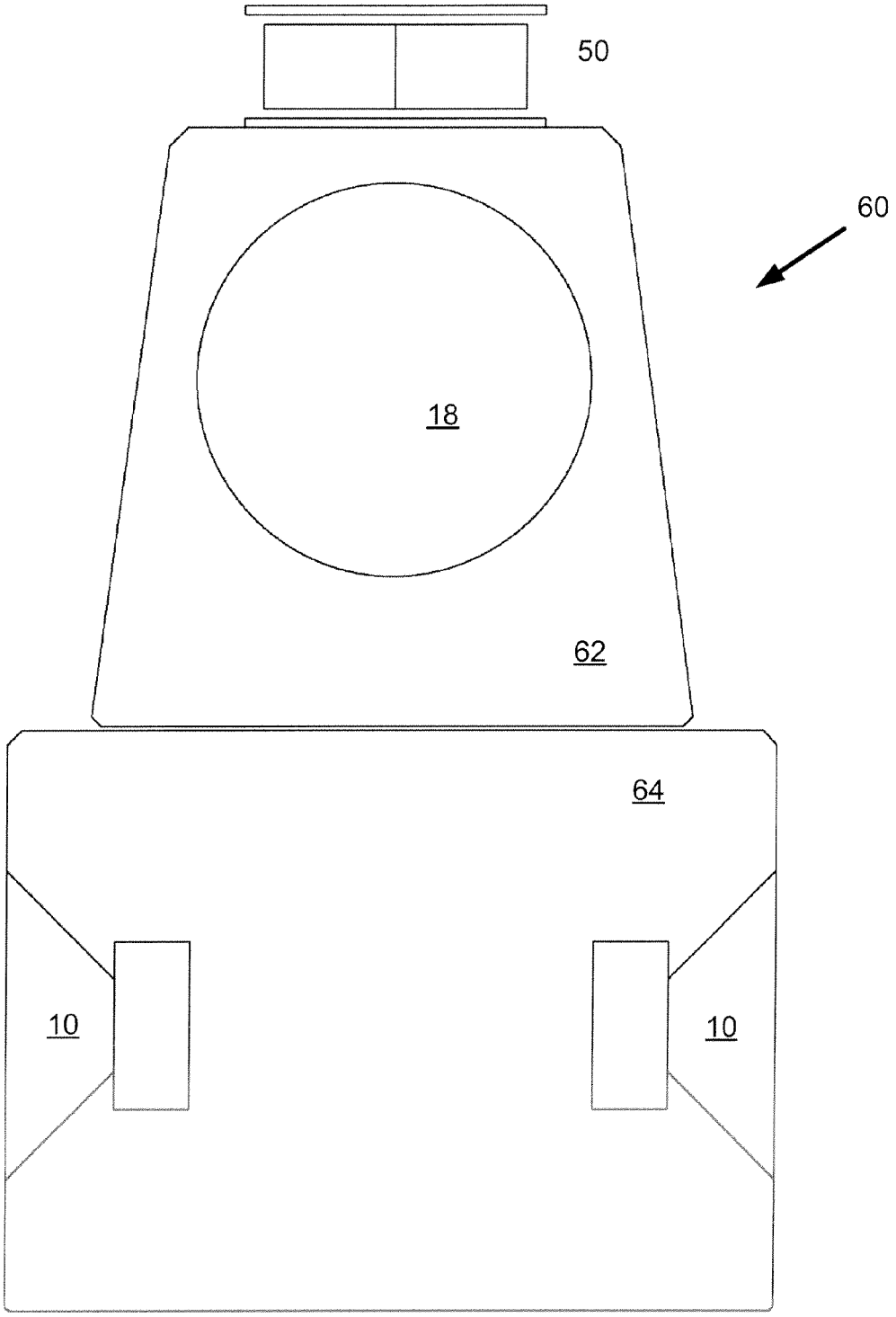
FIG. 11 is a diagram of a loudspeaker system in accordance with an exemplary embodiment of the present invention.

Another exemplary embodiment of a loudspeaker system 60 with these elements as described above is shown in FIG. 11, which shows a bending-wave transducer 50, placed on an enclosure 62 with a mid-range transducer 18, placed on two opposing woofers 10 in an enclosure 64.

In yet another exemplary embodiment, the principles of the present invention may be used in a speaker or speakers used with videoconferencing and teleconferencing, music playback systems, televisions, video, radios, cell phones, smart phones, in-ear earphones, and hearing aids, and other applications where speakers are used.

It should be understood that the embodiments and examples described herein have been chosen and described in order to best illustrate the principles, methods, and processes of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A speaker system, comprising:

a resistance-controlled transducer, coupled to a unsymmetrical crossover network adapted to remove causal delay, said transducer comprising a diaphragm or cone with a voice coil, and a motor with a pole-piece with a conductive shorting ring, said shorting ring located in close proximity to and at the same height as the voice coil; and a mass-controlled transducer, coupled to the unsymmetrical crossover network adapted to remove causal delay, said transducer comprising a diaphragm or cone with a voice coil, and a motor with a pole-piece with a conductive shorting ring, said shorting ring located in close proximity to and at the same height as the voice coil;

wherein electrical input impedance to the system is independent of frequency in both magnitude and phase; and further wherein the speaker system exhibits flat delay response.

2. The speaker system of claim 1, wherein the resistance-controlled transducer is a high-range bending-wave transducer.

3. The speaker system of claim 1, wherein the resistance-controlled transducer is contained in an in-ear earphone.

4. The speaker system of claim 1, wherein the resistance-controlled transducer is contained in a hearing aid device.

5. The speaker of claim 1, wherein the speaker system stimulates limbic system response.

6. A speaker system, comprising:

a mass-controlled transducer, coupled to a unsymmetrical crossover network adapted to remove causal delay, said transducer comprising a diaphragm or cone with a voice coil, and a motor with a pole-piece with a conductive shorting ring, said shorting ring located in close proximity to and at the same height as the voice coil;

wherein electrical input impedance to the system is independent of frequency in both magnitude and phase; and further wherein the speaker system exhibits flat delay response.

7. The speaker system of claim 6, wherein the transducer is a mid-range transducer.

8. The speaker system of claim 6, wherein the transducer is contained in an in-ear earphone.

9. The speaker system of claim 6, wherein the transducer is contained in a hearing aid device.

10. The speaker system of claim 6, wherein the speaker system stimulates limbic system response.

* * * * *